United States Patent [19]

Mosterd

[11] 4,121,321

[45] Oct. 24, 1978

[54] DEVICE FOR MODELLING POULTRY

[75] Inventor: Jacob Hendrik Mosterd, Barneveld, Netherlands

[73] Assignee: MOBA Holding Barneveld B.V., Barneveld, Netherlands

[21] Appl. No.: 783,565

[22] Filed: Apr. 1, 1977

[30] Foreign Application Priority Data

Apr. 7, 1976 [NL] Netherlands ..... 7603625

[51] Int. Cl.[2] ..... A22C 21/00

[52] U.S. Cl. ..... 17/11; 17/45

[58] Field of Search ..... 17/11, 45, 48

[56] References Cited

U.S. PATENT DOCUMENTS

| | | | |
|---|---|---|---|
| 2,560,067 | 7/1951 | Bell | 17/11 |
| 3,474,489 | 10/1969 | Kliewier et al. | 17/11 |
| 3,541,634 | 11/1970 | Panek | 17/11 |
| 3,675,272 | 7/1972 | Schacht | 17/11 |
| 3,864,787 | 2/1975 | Mosterd | 17/11 |

*Primary Examiner*—Louis G. Mancene

*Assistant Examiner*—Paul J. Hirsch

*Attorney, Agent, or Firm*—Larson, Taylor and Hinds

[57] ABSTRACT

A poultry modelling machine having pivotably mounted shell members for positioning the portions of a fowl, such as a chicken such that specially the wings are correctly positioned against the fowl's body for packing purposes, in which flaps are present for catching or guiding the fowl's wings before the shell members close.

10 Claims, 13 Drawing Figures

DEVICE FOR MODELLING POULTRY

The invention relates to a device for modelling poultry, provided with a modelling apparatus containing a first shell member and pivotably connected to opposed end edges of said first shell member two further shell members having free edges opposed to said end edges said further shell members being pivotable from an open position, in which the said free ends are spaced from each other towards a closed position in which said free ends substantially engage, so that the shell members together form a tube, and driving means for pivoting said further shell members from the open into the closed position. A device of this type has been described in the U.S. Pat. No. 3,864,787 of applicant.

Though this known device enables very satisfactory results, it has been shown, that the irregularity with which the wings depend from the fowl or the fact that the wings may be damaged or fractured, nevertheless may give rise to disturbances.

It is a first aim of the invention to eliminate this disadvantage.

Accordingly the invention provided a device of the indicated type that is provided with pivotably mounted flaps having free edges and movable from a first position into a second position their free edges being spaced apart further in the first than in the second position, in the latter position at least one edge of the flaps being adjacent to the free edges of the said further shell members when these are in their open position, and means for moving said flaps.

Because with the invention said flaps guide and to some extend enclose the wings before the modelling apparatus closes, the chance of disturbance caused by irregular or fractured wings is considerably reduced.

Practice has shown, that according to a further elaboration of the invention it is favourable if the flaps at their ends are bent towards each other.

In the cited publication a pressure sheet has been described, that is movable towards the shell members and away from them.

According to a further elaboration of the invention it is provided that such a pressure sheet is movable from a first position, in which it is spaced from the said two shell members towards a second position, in which it engages the free ends of the said two shell members when the latter are in their open position. With this embodiment of the invention the fowl with its depending wings is enclosed at three sides by the pressure sheet and the flaps, so that irregularities are prevented when inserting the fowl in the modelling apparatus.

According to still a further elaboration of this embodiment of the invention it is provided that the pressure sheet moves from said second position towards a third position concomitant with the movement of the said two shell members from their open position to their closed position, such that the pressure sheet contacts the free ends of said two shell members during these movements.

Herewith it is prevented that during the closing movement of the said two shell members the fowl or part of it comes between the said two shell members which would impede the closing movement. In fact the three sides' enclosure when the fowl is between the flaps and the pressure sheet becomes a complete enclosure when it is between the pressure sheet, the said two shell members and the third shell member.

These and further features and advantages of the invention are elucidated by the description of the accompanying drawings in which FIG. 1, 2 and 3 show side views of three successive positions of a first embodiment of the invention;

Figure 1:
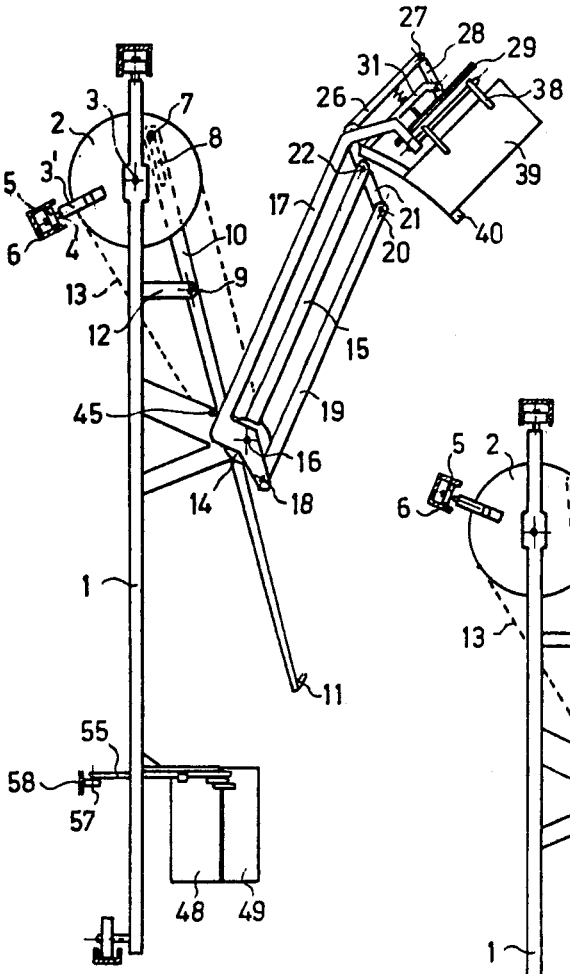
Figure 2:
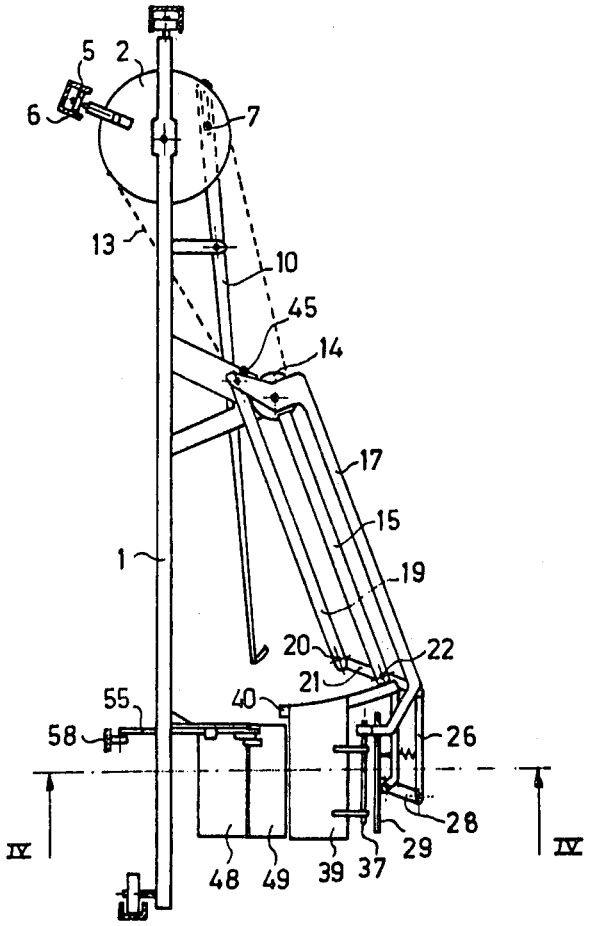
Figure 3:
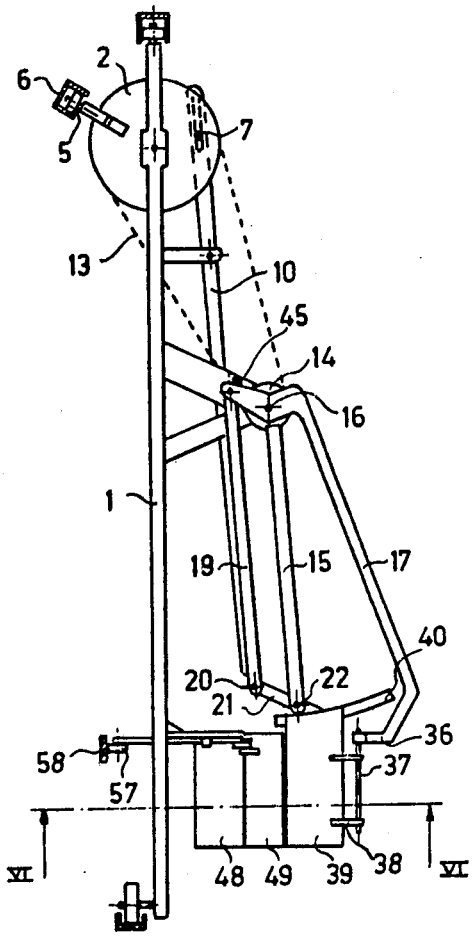
FIG. 3A shows an end view of the device in the position of FIG. 3.
Figure 3A:
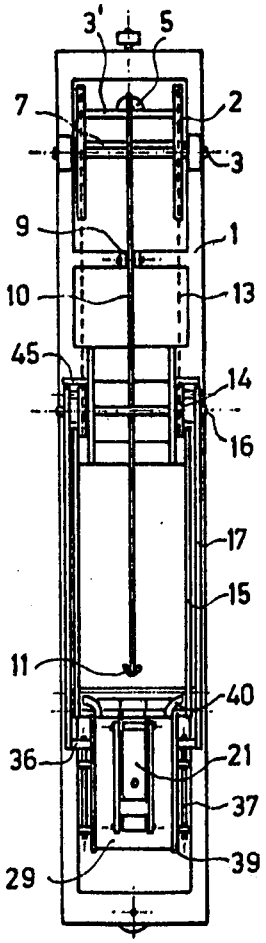

In the drawings reference 1 indicates a supporting frame that is movable along a track perpendicular to the plane of drawing of FIGS. 1, 2 and 3. Two chain wheels 2 are fixedly connected to a rotatable shaft 3 supported by frame 1. A member 3' connecting said two wheels 2 is provided with a radially oriented shaft 4, on which a follower roller 5 is mounted that engages a guide 6 having an U-shaped cross section. The shape of this guide is such, that the wheels 2 are rotated from the position of FIG. 1 via that of FIG. 2 in that of FIG. 3 and even somewhat further.

The chain wheels 2 bear a pin 7 that is inserted in a slit 8 provided in an arm 10 that is pivotable about a shaft and that at is lower side is provided with a hook 11, in which a fowl can be hung by its knee joints. Shaft 9 is supported by a couple of supports 12.

Chains 13 run on the chain wheels 2 and at their lower side on chain wheels 14. Arms 15 are fixedly connected to these chain wheels 14. A couple of angle levers 17 is freely rotatable on the shaft 16 of the chain wheels 14. The short arms of the angle levers support at their ends pins 18 on which links 19 are mounted. Each link 19 has at its lower end a pivot-connection 20 with a sheet 21 that is angled with an obtuse angle (vide also FIG. 5). The sheet 21 further is connected to a sleeve 23, in which a shaft 22 is mounted that is connected to the arms 15. Consequently the arms 15, the short arms of the levers 17, the links 19 and the sheet 21 from a parallelogram linkage with pivots 16, 18, 20 and 22.

The sheet 21 bears a couple of sleeves 24 bearing a pin 25 to which a couple of arms 26 is pivotably connected. At their ends the arms 26 have pivot connections 27 with the links 28 which support at their ends a pressure plate or sheet 29. The links 28 are further by means of pivots 30, bars 31 and the shaft 22 coupled with the sheet 21, so that members 21, 26, 28 and 31 form a parallelogram linkage. Further the links 31 support a traverse member 32 having a hole through which a bar 34 passes that is fixedly connected to the sheet 29. The sheet 29 is at its center and at its lower side provided with a rib 29. Between the end portion of sheet 21 and the traverse member 32 a compression spring 35 has been mounted.

The angle levers 17 are bent at their free ends and support end portions 36 bearing shafts 37. Pivot arms 38 are pivotably connected to said shafts and support flaps 39. Guiding channels 40 having an U-shaped cross section are fixedly mounted to said flaps. In each channel 40 a roller 41 is guided, that is mounted to a shaft 42 that is fixedly mounted in traverse bars 43 fixedly connected to arms 15. The traverse bars are connected to each other by the shaft 22 which supports at its center portion the sleeve 23 which is fixedly connected to the sheet 21.

Figure 10:
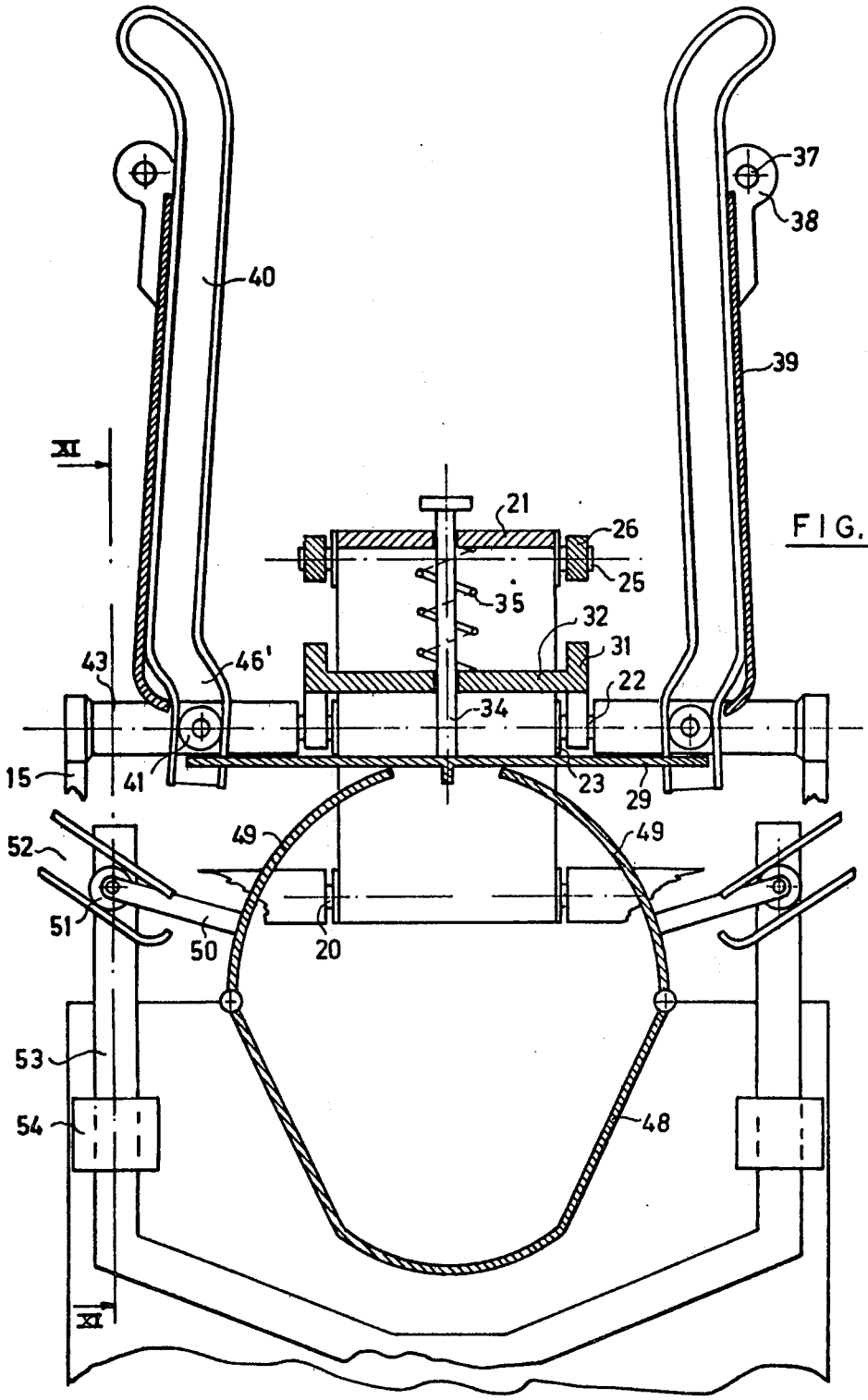
FIG. 10 shows a cross section corresponding to FIGS. 6 and 8, but in a further position of the device.
Figure 11:
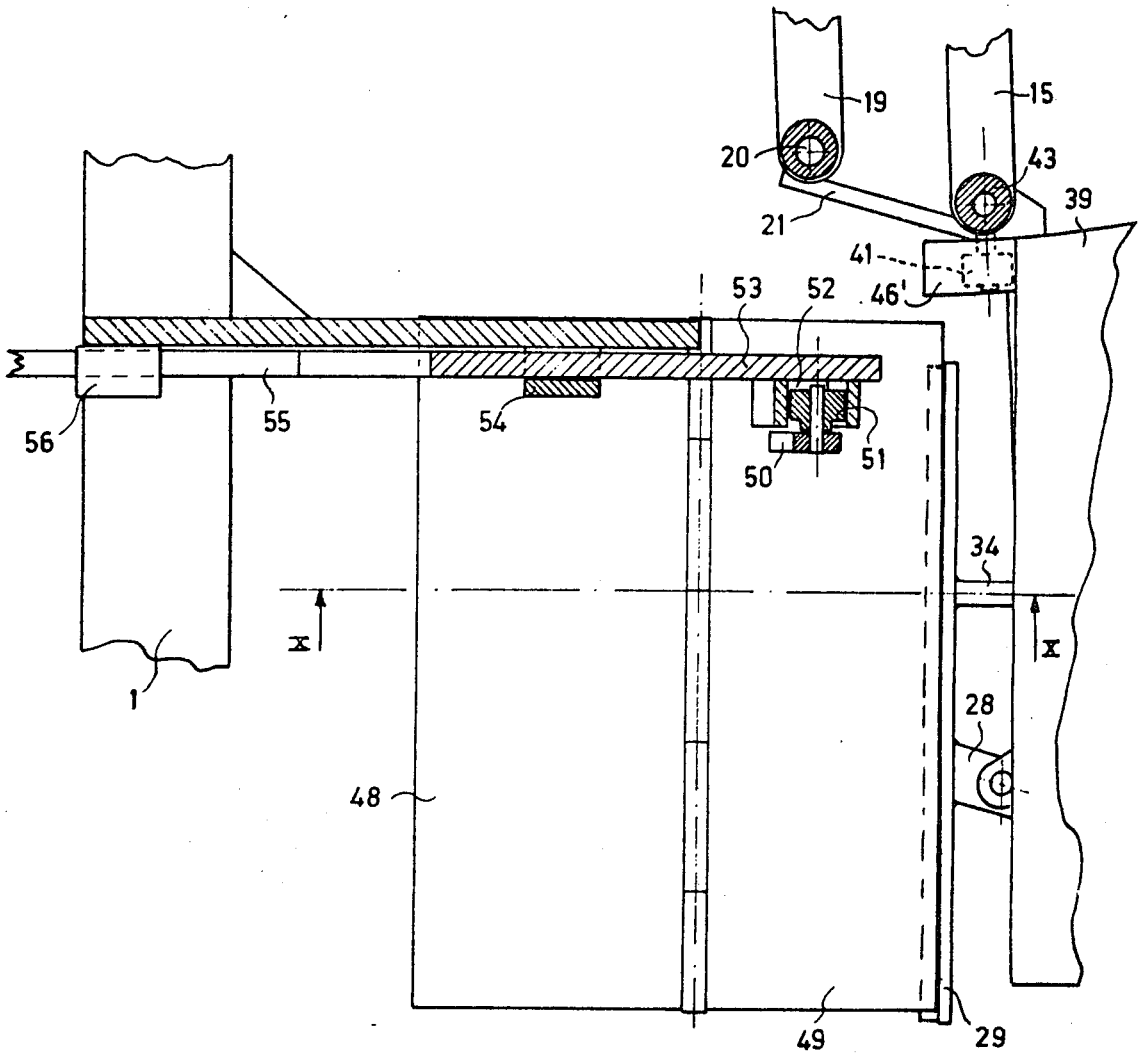
FIG. 11 shows a vertical cross section of the modelling apparatus in the position of FIG. 10.
Figure 12:
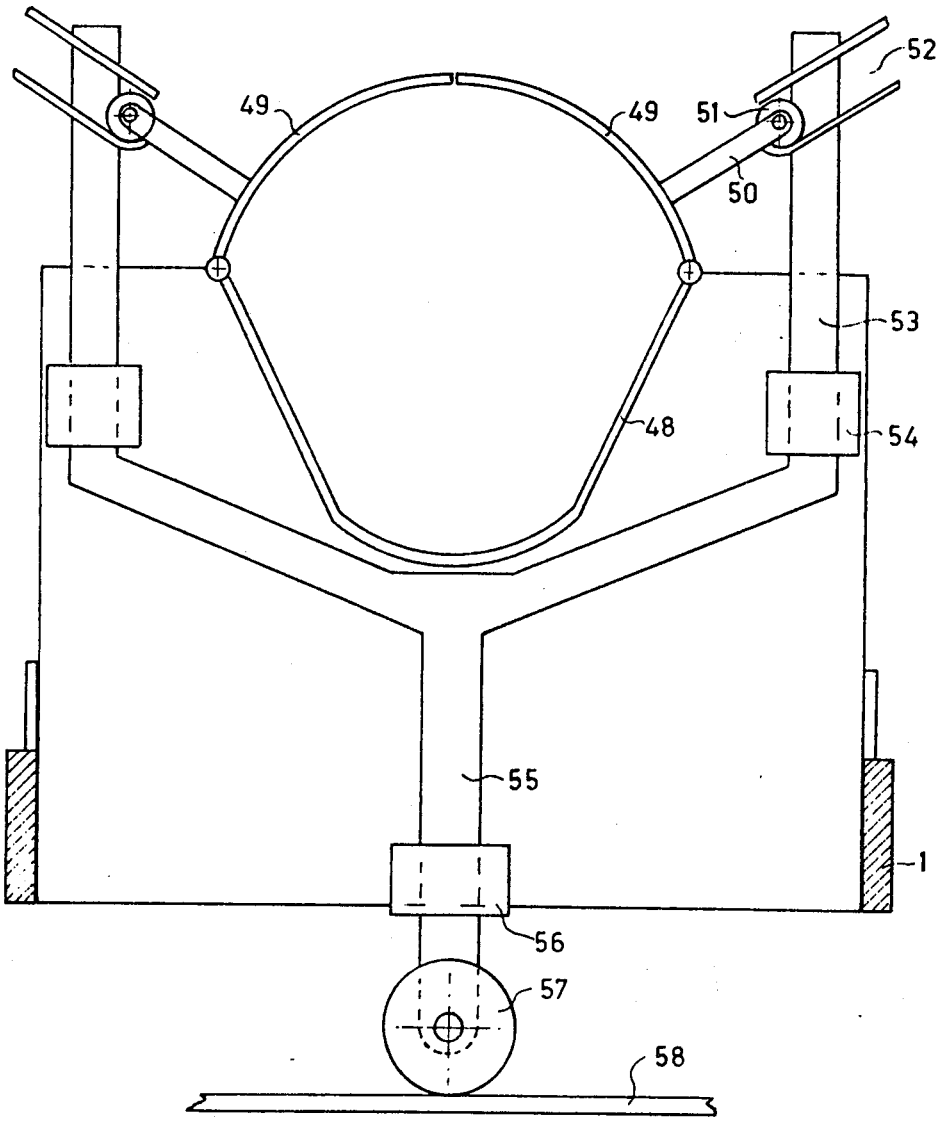
FIG. 12 shows the modelling apparatus in the closed position.

By gravity which exerts a clock-wise momentum on the arms 17 with respect to the axis 16 the arms 15, 17 and 19 are forced in the positions indicated in FIGS. 1 and 2. The position of the flaps 39 that has been indicated in FIG. 4 corresponds to this. Because the rollers 41 are stopped by the ends 44 of the guide channels 40 this position is stable. Fixed abutments 45 are mounted to the supporting frame 1 that supports the shaft 16 and the members 15, 19 and 17. The short arms of the angled levers 17 engage the abutments 45 in the position of FIG. 2. If now the arms 15 are rotated further clockwise by the chains 13 and the chain wheels 2 and 14, the angle levers 17 cannot pivot further clock-wise and a relative motion occurs of the arms 15 and 19 with respect to the angle levers 17, by reason of which the rollers 41 are displaced in the guide channels 40. Consequently they move from the position of FIG. 4 via the positions of FIGS. 6 and 8 towards the position of FIG. 10. By the shape of the guide channels the flaps 39 herewith are firstly pivoted towards each other to the position of FIG. 6, in which they are substantially parallel. This happens under influence of the curved portions 46 of the guide channels 40. When the rollers 41 run through the straight portions of the channels the flaps do not pivot. Only at the end of the movement of the rollers 41 in the channels 40, when they are in the oblique portion 48 of these channels, the flaps 39 are pivoted again and this time somewhat outwardly.

Herewith the pressure sheet 29 moves between the flaps so that, after the flaps have been brought in their parallel position (FIG. 6) very little space is present between the sheet 29 and the flaps 39.

Mounted to the support frame 1 is a modelling apparatus essentially corresponding to the older proposal of applicant mentioned earlier. It contains a fixed shell member 48 and pivotably connected therewith the shell members 49. An arm 50 is fixedly connected with each of the shell members 49 and supports at its end a roller 51. These rollers run in guide channels 52 supported by a bracket 53 that is movable in glide-bearings 54. Bracket 53 further supports a control bar 55 which is guided in a glide bearing and at its end is provided with a roller 57, which runs against a guide 58 fixedly mounted along the track of support 1.

The working of the described device is the following: In the position of FIG. 1 a fowl is hung by its knee-joints in the hook 11, that is very well accessible, because the arms 15, 17 and 19 are pivoted upwardly. By the shape (not shown) of the guide 6 the chain wheels 2 are pivoted clockwise so that the hook 11 moves towards the modelling apparatus 48, 49. If the wings of the fowl depend irregularly and protrude somewhat, they are between the flaps 39 when the device obtains the position of FIG. 2.

Figure 4:
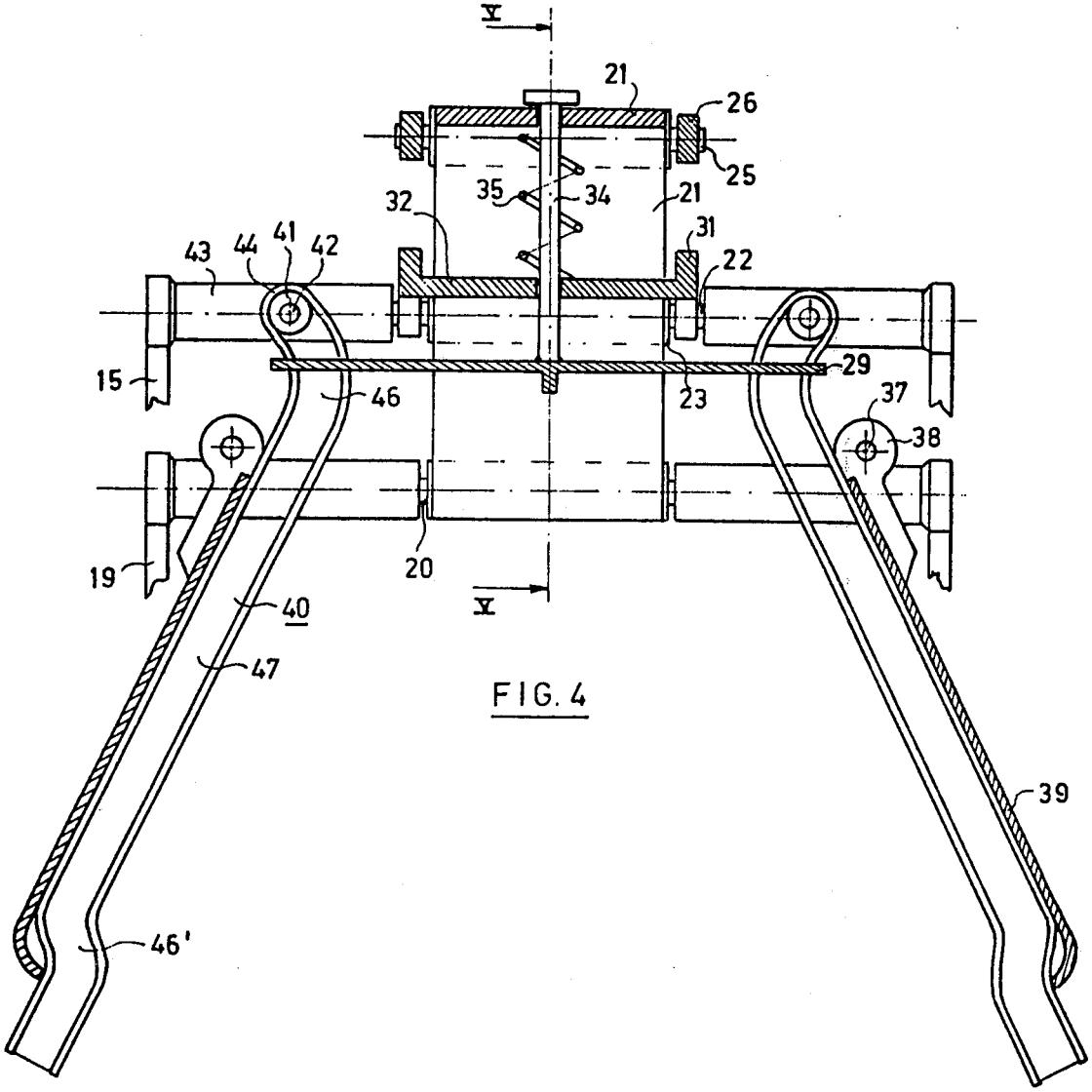
FIG. 4 shows a cross section on an enlarged scale taken over the line IV—IV of FIG. 2.
Figure 5:
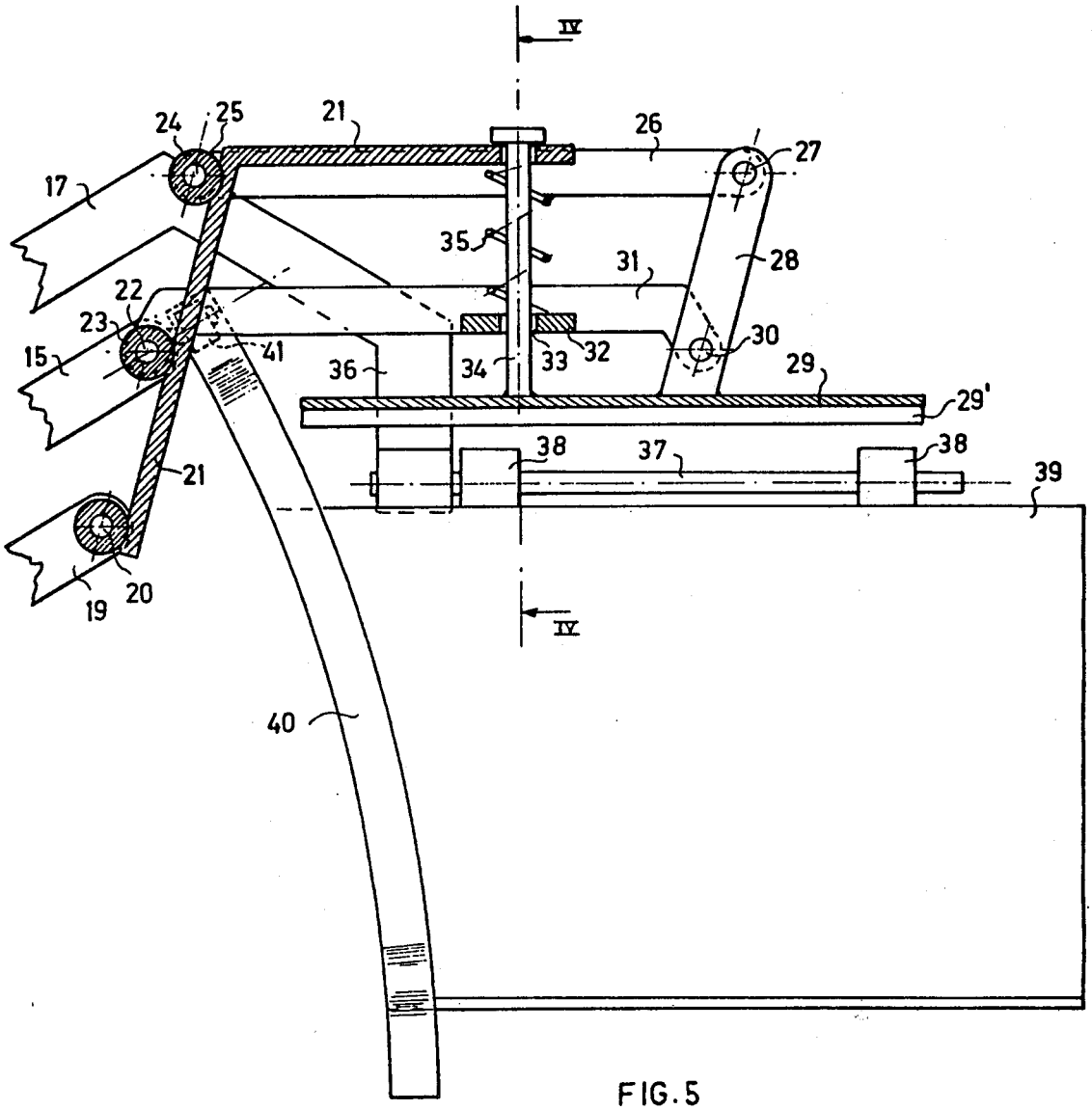
FIG. 5 shows a cross section over the line V—V of FIG. 4.
Figure 6:
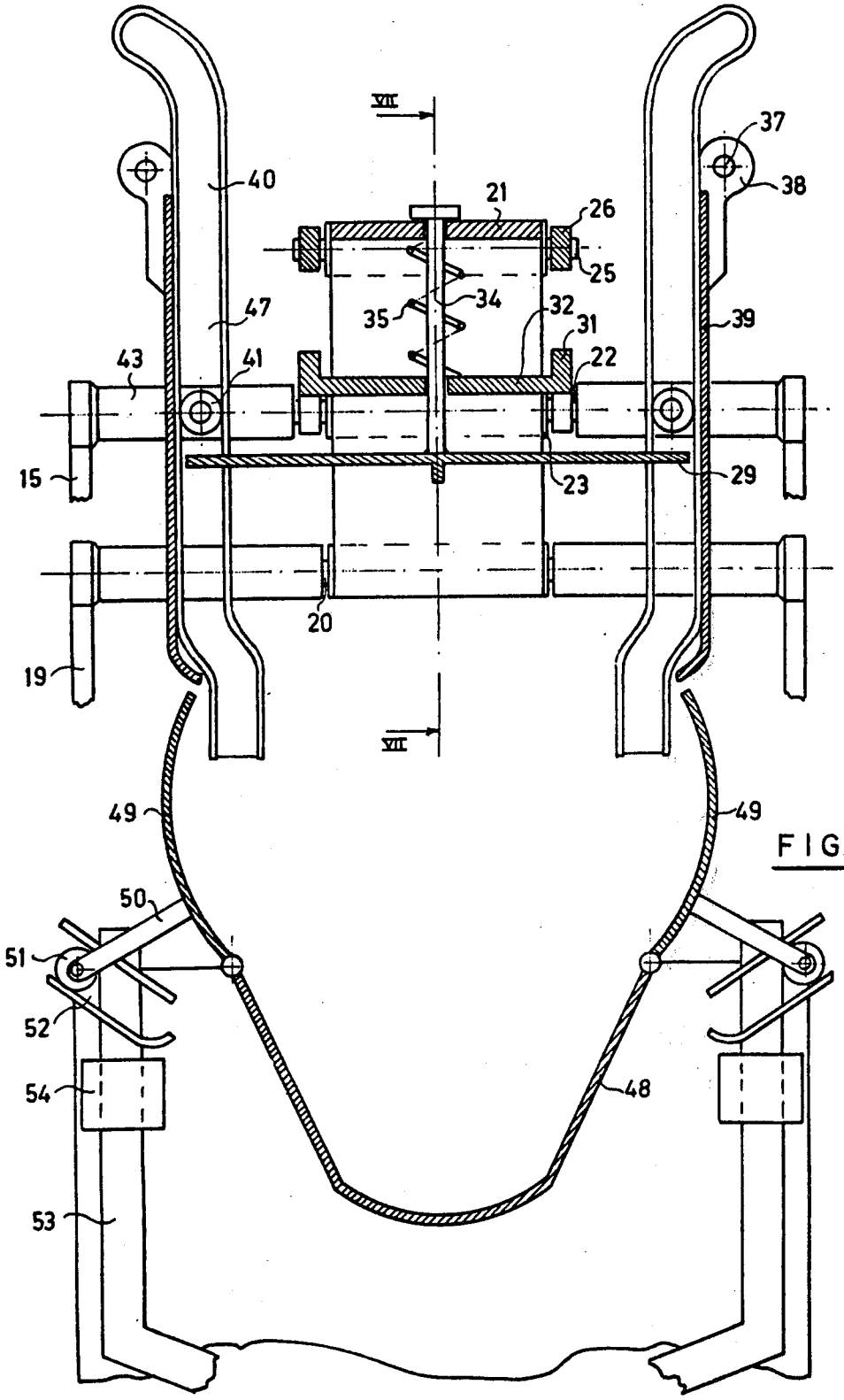
FIG. 6 shows a cross section over the line VI—VI of FIG. 3.
Figure 7:
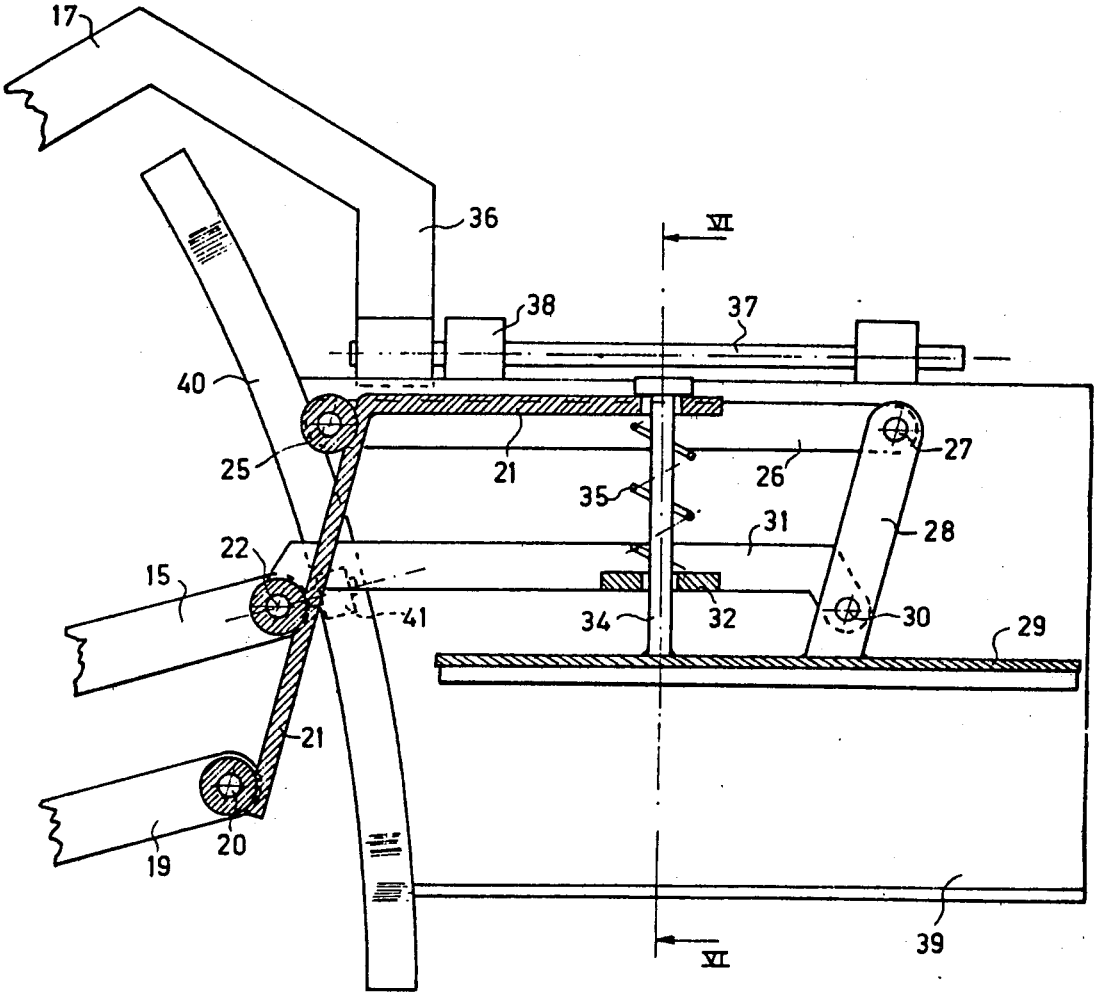
FIG. 7 shows a cross section over the line VII—VII of FIG. 6.

Because then the short arms of angle levers 17 engage the abutments 45 the flaps 39 move from the position of FIGS. 4 and 5 towards that of FIGS. 6 and 7. Herewith the pressure sheet 29 moves from the position of FIGS. 4 and 5 to that of FIGS. 6 and 7. By reason of this the wings are enclosed in the space that is delimited by the pressure sheet 29, the flaps 39 and the pivotable members 49 of the modelling apparatus.

Figure 8:
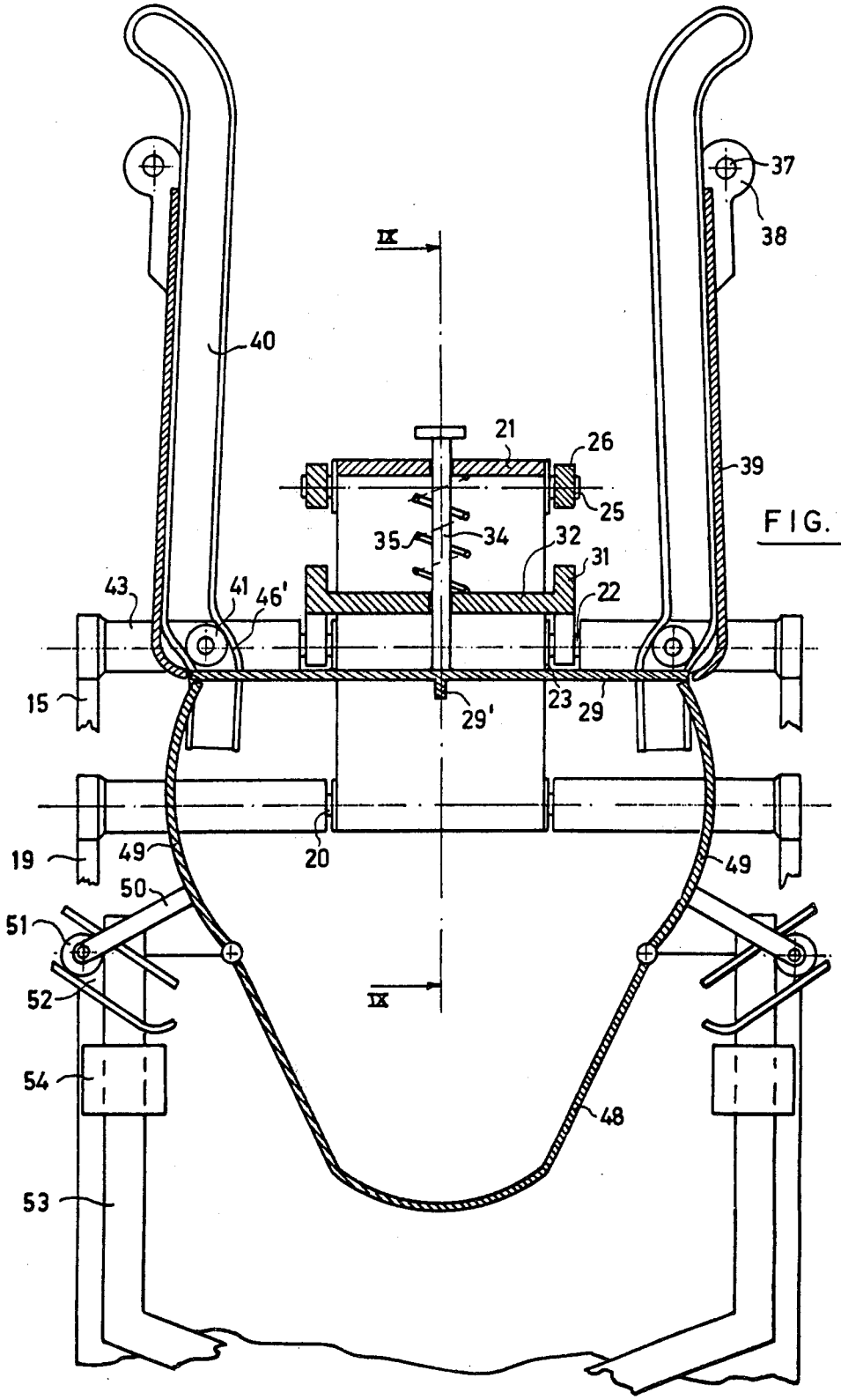
FIG. 8 shows a cross section corresponding to FIG. 6 but in a further position of the device.
Figure 9:
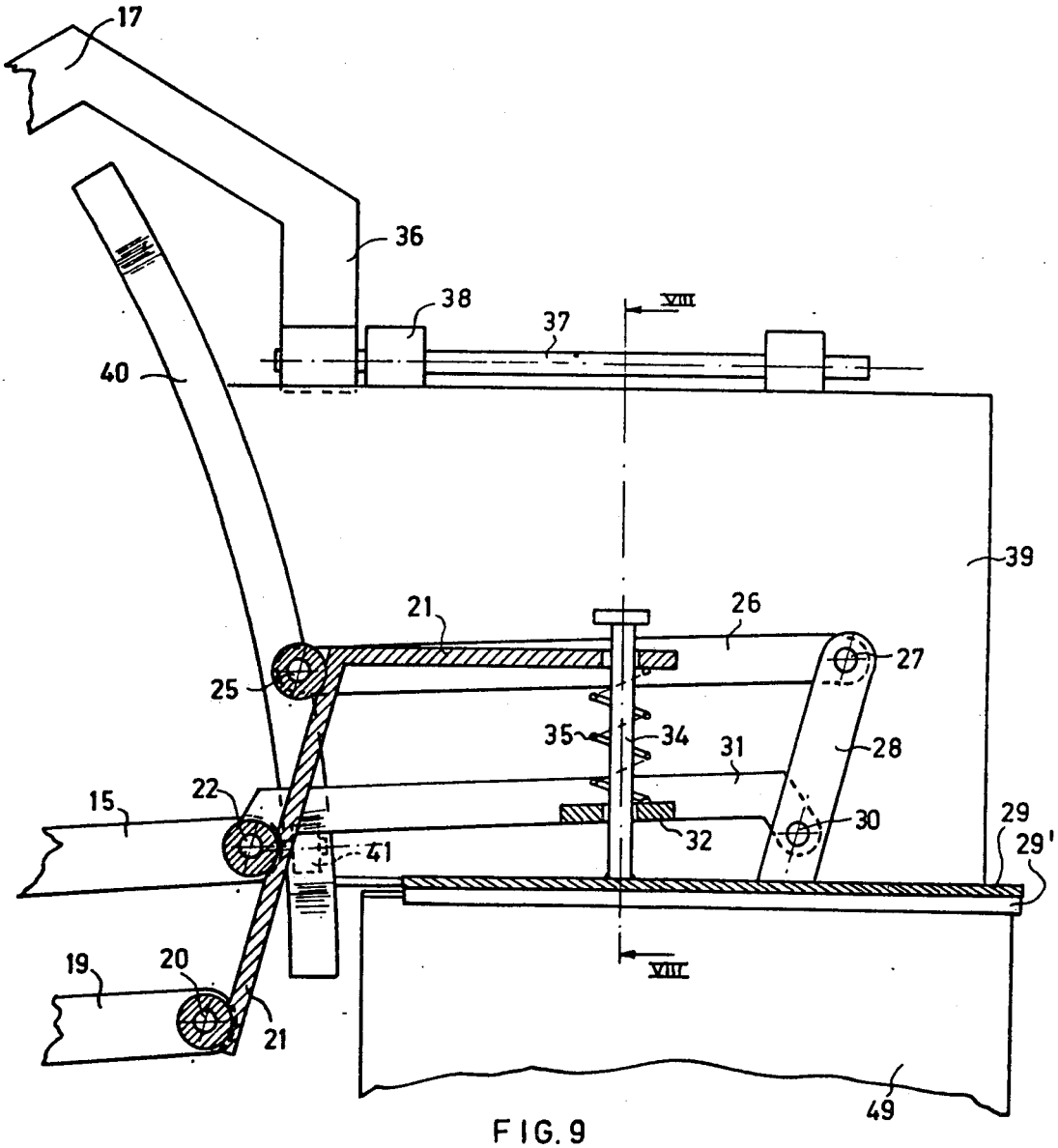
FIG. 9 shows a cross section over the line IX—IX of FIG. 8.

As appears from FIG. 8 the flaps 39 pivot somewhat outwardly when the sheet 29 moves past their ends. The shape of the curved portion 46' of the guide channels 40 is such, that the edges of the sheet 29 remain always at a small distance from the flaps 39. By reason of this the wings of the fowl completely are brought between the pivotable members of the modelling apparatus.

The sheet 29 now engages the ends of the shell members 49 the spring 35 enabling the sheet 29 to yield somewhat when the shell members 49 are pivoted inwardly. Consequently the sheet 29 contacts continuously the shell members 49, so that it is impossible that portions of the fowls wings protrude out of the shell members and are jammed by them after these shell members have been closed. The rib 29' is a further security means to prevent portions of the wings to protrude out of the modelling apparatus at the moment the shell members 49 close.

What I claim is:

1. In a device for modelling poultry, a modelling apparatus including a first shell member, two further shell members each having free edges pivotably connected to opposed end edges of said first shell member, said further shell members being pivotable from an open position, in which the said free ends are spaced from each other towards a closed position in which said free ends substantially engage to form a tube in operable cooperation with said first shell member, and driving means for pivoting said further shell members from the open into the closed position, said device further being provided with pivotably mounted flaps (39) having free edges and movable from a first position into a second position, said free edges being spaced apart further in the first than in the second position, and in the second position at least one edge of the flaps being adjacent to the free edges of the said further shell members when said further shell members are in the open position and means for moving said flaps.

2. A device according to claim 1 in which the flaps near the free edges are curved towards each other.

3. A device according to claim 1 in which a pressure plate (29) is movably mounted for movement from a first position spaced from said further shell members towards a second position adjacent said further shell members.

4. A device according to claim 3 in which the pressure plate is movable from said second position to a third position in contact with the free ends of the two further shell members, and in which driving means for moving said pressure plate are provided, said driving means being coupled to the driving means for pivoting said further shell members, such that the pressure sheet engages the free ends of the further shell members when at the same time the further shell members move to their closed position and the pressure sheet from the second to the third position.

5. A device according to claim 4 in which the pressure sheet is yieldably mounted.

6. A device according to claim 4 in which the pressure sheet in its center is provided with a rib (29').

7. A device according to claim 1 in which the flaps are mounted to a support that is pivotably mounted and in which means are present to pivot said support to move the flaps towards the modelling apparatus or away from it.

8. A device according to claim 4 in which a further pivotable support bears the pressure plate.

9. A device according to claim 8 in which guide members and guide follower members are connected to the flaps and the pressure plate, such that the relative movement between the first pivotable support and the second pivotable support couples the pivot movement of the flaps to the alternating movement of the pressure sheet.

10. A device according to claim 1 provided with means for supporting a fowl, containing a movably mounted suspension hook for a fowl and means for moving said hook, said means being coupled with the said means for moving the flaps and adapted to move said hook towards the modelling apparatus and away from it.

* * * * *